US005314178A

United States Patent [19]

Cole, Jr. et al.

[11] Patent Number: 5,314,178

[45] Date of Patent: May 24, 1994

[54] AUTOMATIC FEEDER FOR WORKPIECES OF LIMP MATERIAL

[75] Inventors: William R. Cole, Jr.; Joel D. Clanton, both of Shelbyville, Tenn.

[73] Assignee: Ark, Inc., Shelbyville, Tenn.

[21] Appl. No.: 976,894

[22] Filed: Nov. 16, 1992

[51] Int. Cl.[5] ..... B65H 3/22

[52] U.S. Cl. ..... 271/18.3; 221/213

[58] Field of Search ..... 271/18.3, 33, 35, 23, 271/115; 221/213, 214, 215, 216

[56] References Cited

U.S. PATENT DOCUMENTS

| | | | |
|---|---|---|---|
| 626,676 | 6/1899 | Crowell . | |
| 823,936 | 6/1906 | Dick | 271/23 |
| 859,853 | 7/1907 | Stewart | 221/216 |
| 3,369,803 | 2/1968 | Walton et al. | 271/10 |
| 3,406,961 | 10/1968 | Walton | 271/10 |
| 3,583,341 | 6/1971 | Birdsong et al. | 112/121.29 |
| 3,670,674 | 6/1972 | Conner, Jr. | 112/121.29 |
| 3,765,672 | 10/1973 | Conner, Jr. | 271/10 |
| 4,359,214 | 11/1982 | Eldridge | 271/5 |
| 4,372,549 | 2/1983 | Stiernspetz | 271/23 |
| 4,572,357 | 2/1986 | Pearl | 198/693 |
| 5,111,759 | 5/1992 | Hiramatsu et al. | 271/23 |
| 5,149,077 | 9/1992 | Martin et al. | 271/18.3 |

FOREIGN PATENT DOCUMENTS

| | | | |
|---|---|---|---|
| 2241480 | 3/1975 | France | 271/18.3 |
| 7415310 | 5/1976 | Netherlands | 271/18.3 |

*Primary Examiner*—H. Grant Skaggs

*Attorney, Agent, or Firm*—Senniger, Powers, Leavitt & Roedel

[57] ABSTRACT

An automatic feeder for feeding workpieces of limp material one after another from a stack of workpieces, the feeder includes a moving support mechanism for supporting the stack, and a gripper located generally underneath the stack and the moving support mechanism. The gripper has a multiplicity of needles on it for gripping the bottom workpiece, and the support mechanism has an opening in it for exposing the bottom workpiece in the stack to the needles. A motor actuates relative motion between the support mechanism and the stack and the gripper and the stack such that the opening in the support mechanism and the gripper pass conjointly under the stack in a direction generally from one end of the stack to the other thereby to progressively present areas of the bottom workpiece over the opening. The needles of the gripper progressively and successively grip at least a portion of areas of the bottom workpiece as they are exposed to the needles over the opening in the support mechanism to peel the area of the bottom workpiece generally downwardly away from the stack. The gripper releases the area peeled away to separate the bottom workpiece from the stack.

22 Claims, 6 Drawing Sheets 42F
148
44
152
146A
40F
148
104
102
146
52
100
W
50
94
118
120
40R
122
44
42R
28

42F
152
W'
146
40R
W
50
94
122
42R
28

42F
28
152
W
W'
50
42R
94
122

AUTOMATIC FEEDER FOR WORKPIECES OF LIMP MATERIAL

The U.S. Government has a paid-up license in this invention and the right in limited circumstances to require the patent owner to license others on reasonable terms as provided by the terms of Contract No. DLA 900-87-C-0509 awarded by the Department of Defense.

SUMMARY OF THE INVENTION

This invention relates to automatic feeders for workpieces of limp material and, more particularly, to an automatic feeder for feeding such workpieces one at a time and one after another from the bottom of a stack of workpieces.

Automated processing of workpieces of fabric frequently requires that individual workpieces be separated from a stack of fabric workpieces and fed to other equipment (e.g., a sewing machine) for performing an operation on the workpiece. Presently, automatic feeders separate the top workpiece in the stack from the remainder of the stack for feeding to the processing equipment. Once the stack is depleted, operation of the feeder (and potentially the downstream processing equipment) must be halted while a new stack of workpieces is placed in the feeder. Thus, the existing automatic feeders do not permit completely continuous feeding of workpieces, and create a bottle neck in processing.

The existing top feeders have workpiece grippers which grip the workpiece adjacent an edge and peel the workpiece away from the stack. The grippers are set to move to a particular location to grip the workpiece. Curved or irregularly shaped workpieces may make it difficult for the gripper to grip enough of the workpiece to separate from the stack. Adjustment of the gripper is required when the shape of the workpieces to be fed changes. In addition, the top workpiece in the stack often does not lie flat, making it difficult for automated feeders to grip and separate the top ply. For instance, when the stack is made up of subassemblies (e.g., workpieces which have more layers of fabric in certain areas than in others), there will be a lump in the stack at the location of the additional layers. However, the bottom workpiece in the stack will be generally flat because it lies on a flat supporting surface rather than another workpiece of irregular thickness, as do all of the workpieces in the stack above the bottom workpiece. Moreover, the weight of the workpieces above the bottom workpieces tends to flatten the bottom workpiece against the supporting surface.

Thus, there is a need for an automatic feeder for workpieces of limp material which feeds the workpieces from the bottom of the stack. An example of an automatic feeder of paper workpieces which separates and feeds the bottom workpiece in a stack is shown in U.S. Pat. No. 626,676. The disclosed automatic feeder has a shaft with a plurality of "bent hooks" projecting outwardly from it. A mechanism is provided to automatically operate the hooks to extend between the bottom workpiece and the workpiece immediately above the bottom workpiece in the stack and to clamp a leading edge of the bottom workpiece against pulleys. The pulleys and shaft are advanced and are rotated so that the bottom workpiece is peeled away from the next workpiece by its leading edge. Before the bottom workpiece is completely separated, the shaft is operated to release the grip of the hooks on the leading edge. The frictional engagement of the pulleys against the workpiece is stated to provide sufficient force to separate the remainder of the bottom workpiece from the stack.

It is impractical to attempt to capture a leading edge of a bottom workpiece in a stack due to the delicacy of operation required from the capturing mechanism. Fine adjustments would be required to accommodate workpieces of different thicknesses. As with top feeders, the feeder shown in U.S. Pat. No. 626,676 requires that the leading edge of the workpiece be positioned so that it can be grasped. The requirement of a generally straight leading edge makes it difficult or impossible to handle curved or irregularly shaped workpieces. Workpieces which tend to stick together, such as adjacent workpieces of fabric held together by entanglement of their fibers, require that a grip on the bottom workpiece be maintained until complete separation is achieved. Moreover, it is believed that merely gripping at the leading edge of the bottom workpiece when the workpieces tend to adhere to each other, will tend to cause other workpieces in the stack to be pulled down along with the bottom workpiece.

Among the several objects and features of the present invention may be noted the provision of an automatic feeder for feeding workpieces of limp material from a stack of workpieces which allows the stack to be replenished without interrupting operation; the provision of such a feeder which readily separates workpieces of nonuniform thickness in a stack; the provision of such a feeder which readily separates workpieces of curved or irregular shapes; the provision of such a feeder which separates workpieces of different shapes without adjustment; the provision of such a feeder which readily separates workpieces tending to adhere to one another; and the provision of such apparatus which operates without disturbing the stack.

Generally, an automatic feeder for feeding workpieces of limp material one after another from a stack of workpieces, comprises means for supporting the stack, and a gripper located generally underneath the stack and support means. The gripper includes means for gripping the bottom workpiece, and the support means has an opening therein for exposing the bottom workpiece in the stack to the gripping means. Means actuates relative motion between the support means and the stack and the gripper and the stack such that the opening in said support means and the gripper pass conjointly under the stack in a direction generally from one end of the stack to the other thereby to progressively present areas of the bottom workpiece over the opening. The gripping means of the gripper progressively and successively grips at least a portion of the areas of the bottom workpiece as they are exposed to the gripping means over the opening to peel the areas of the bottom workpiece generally downwardly away from the stack. The areas of the workpiece peeled away are thereafter released by the gripping means to separate the bottom workpiece from the stack.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
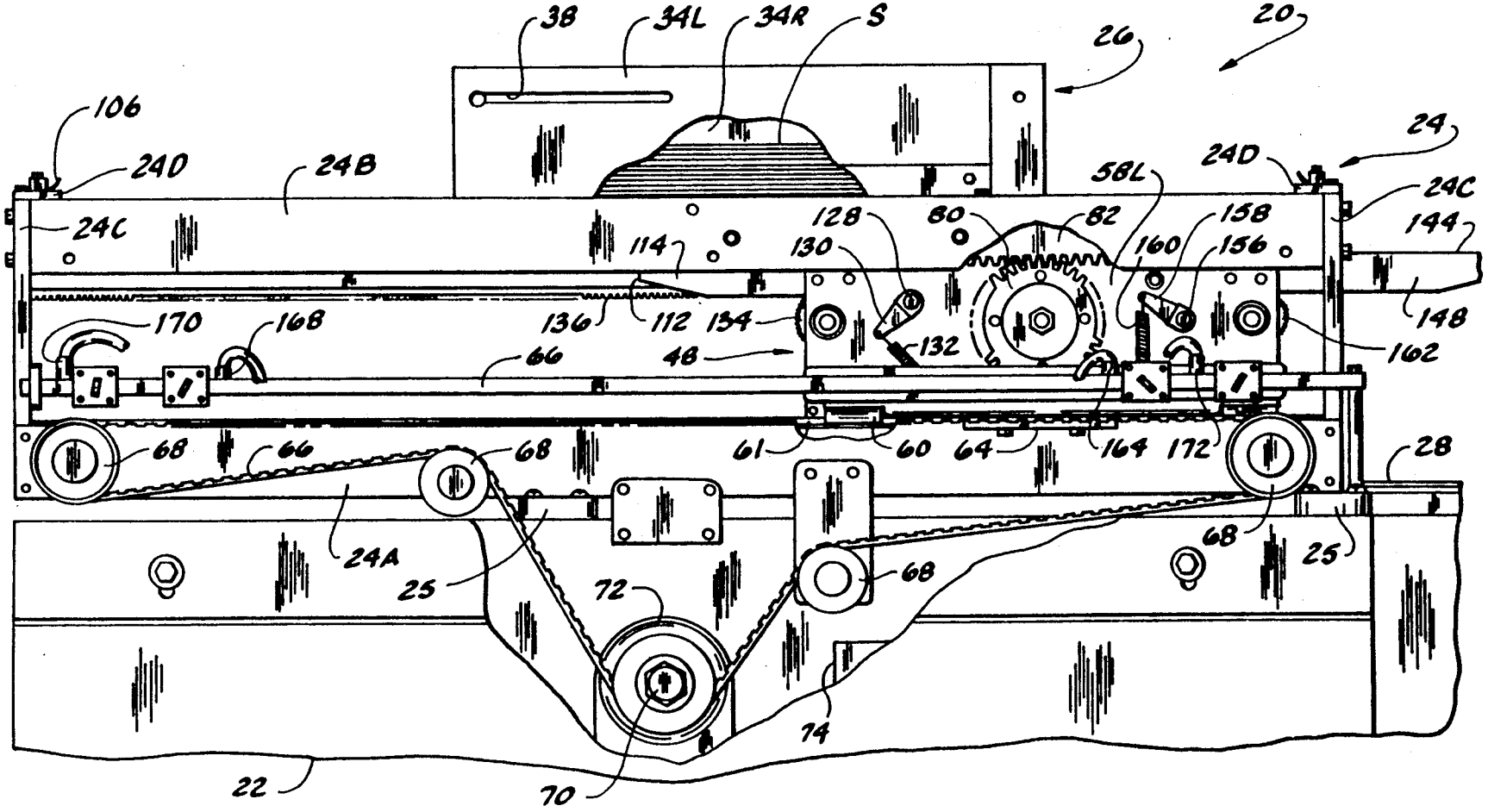
FIG. 1 is a left side fragmentary elevation of an automatic feeder with parts broken away to show details.

Referring now to the drawings, an automatic feeder (generally indicated at 20) constructed according to the principles of the present invention is shown to comprise a base 22, a frame (generally indicated at 24) mounted by blocks 25 on and extending above the base, and a hopper (generally indicated at 26) fixedly mounted on the frame for holding a stack S of fabric workpieces to be fed one at a time and one after another to a conveyor 28 for delivery to processing machinery such as a sewing machine (not shown). The frame 24 includes a pair of laterally spaced lower frame members 24A, a pair of laterally spaced upper frame members 24B and four upright frame members 24C at the corners of the frame mounting the upper frame members above the lower. Cross members 24D interconnect the laterally spaced upright members 24C at the front and rear of the frame. The automatic feeder illustrated herein is particularly adapted for feeding workpieces made of fabric to automated processing machinery. However, it is envisioned that the feeder could also be used to feed workpieces made of material other than fabric.

Figure 5:
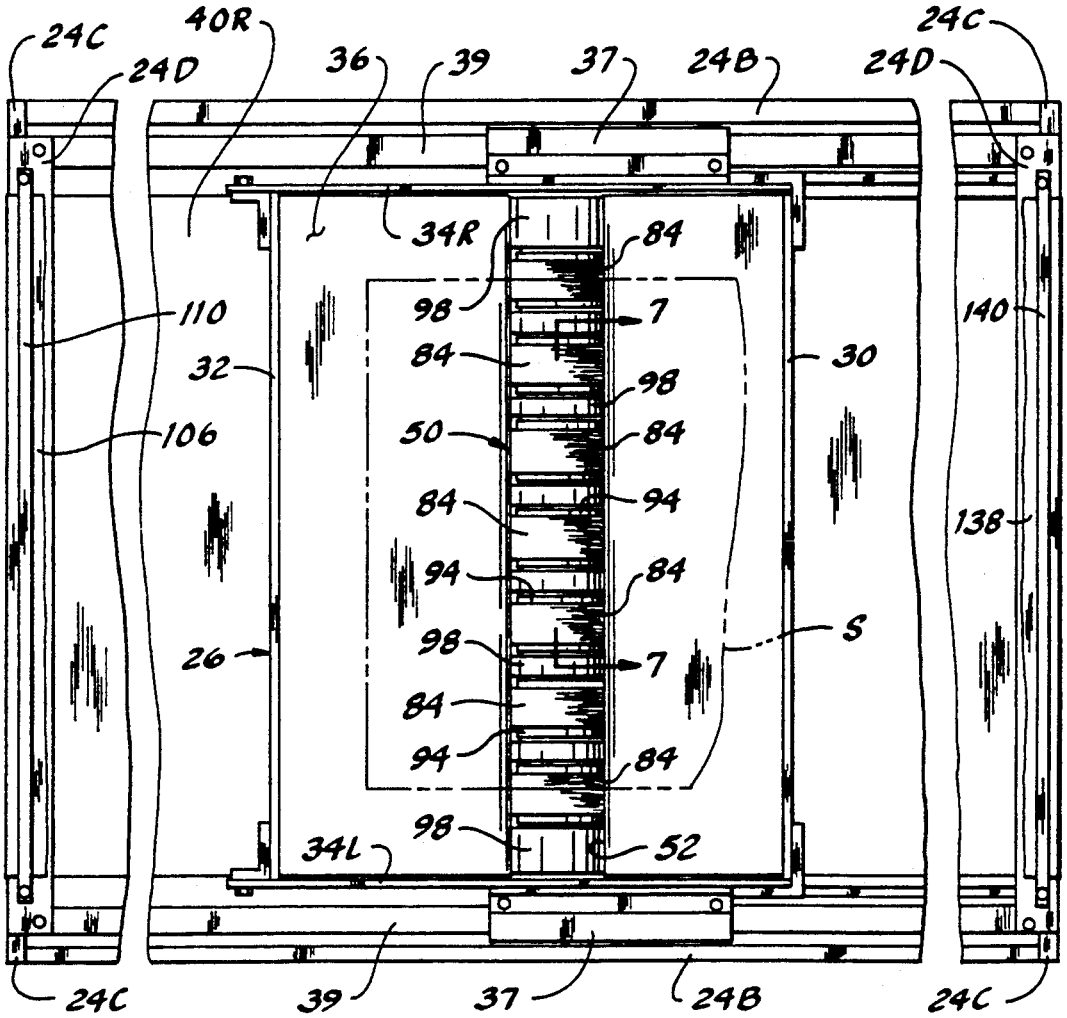
FIG. 5 is a fragmentary top plan view of the automatic feeder.
Figure 6:
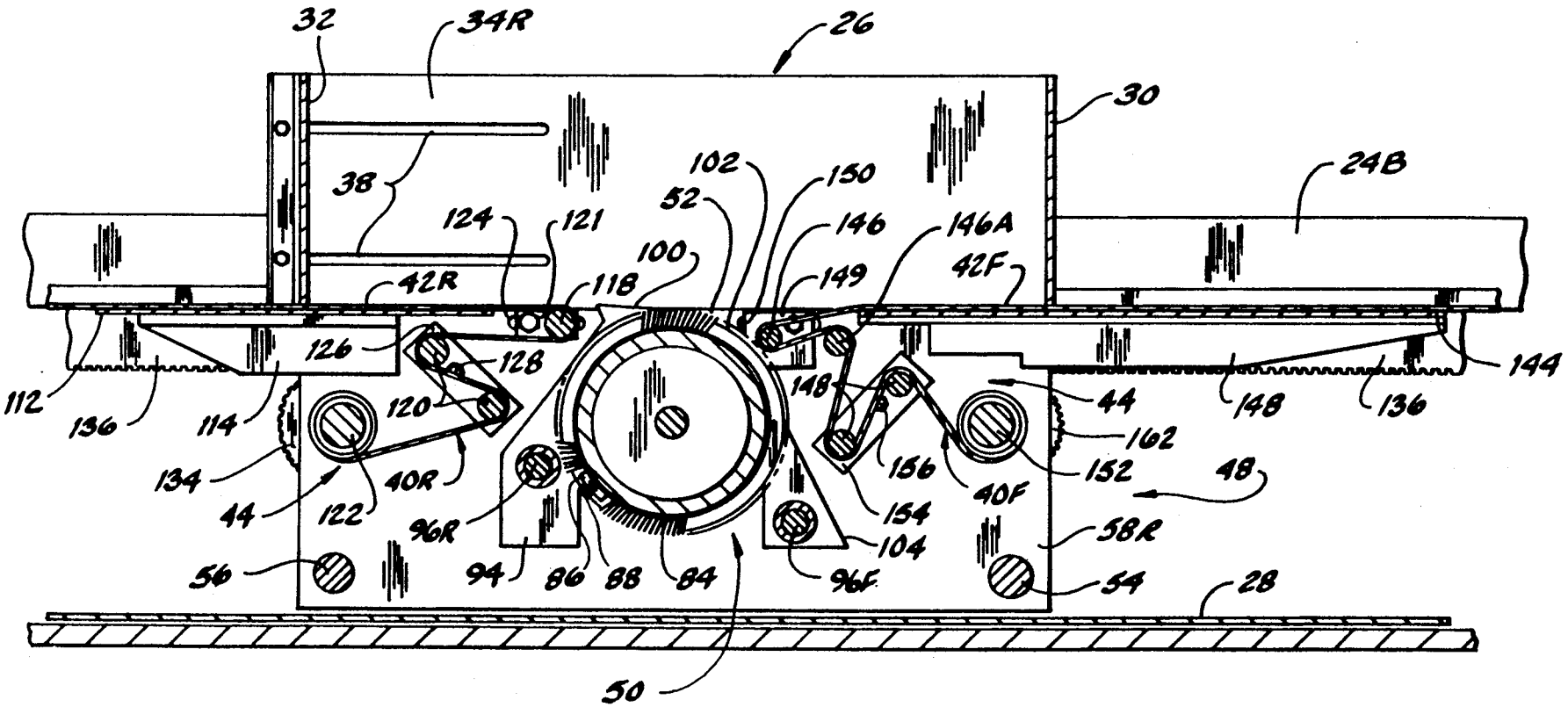
FIG. 6 is vertical section of the automatic feeder with parts removed for clarity.

As shown in FIG. 5, the hopper has a front wall 30, a rear wall 32, spaced apart side walls (designated 34L and 34R, respectively), and an open bottom 36. The hopper 26 is mounted by brackets 37 attached to its sidewalls 34L, 34R on interior upper frame members 39 extending between upright members 24C on each side of the frame. The rear wall 32 is slidably mounted in a pair of slots 38 in the side walls 34L, 34R of the hopper, so that the size of the hopper can be adjusted to accommodate workpieces of different sizes by sliding the rear wall in the slots (FIG. 6). The rear wall 32 is adapted to be secured in a selected position by suitable fasteners (not shown). The stack S is supported in the hopper 26 by front and rear moving support webs, designated generally 40F and 40R, respectively, located under the hopper and defining front and rear support surfaces (designated 42F and 42R, respectively) for the stack. The front and rear webs 40F, 40R are part of a moving support mechanism 44 (broadly, "support means") described in detail hereinafter.

Figure 2:
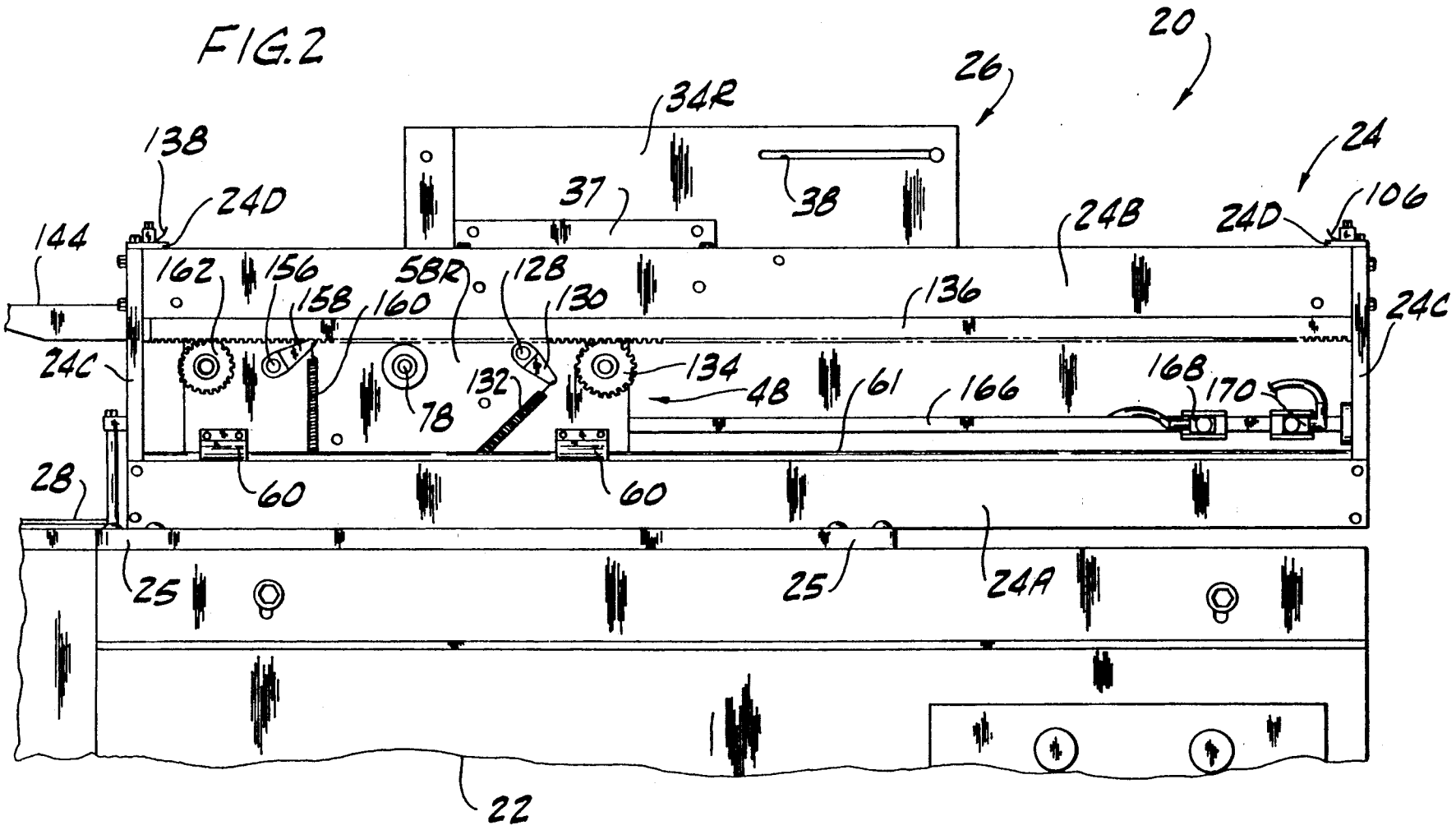
FIG. 2 is a right side elevation thereof.

Referring now to FIGS. 1, 2 and 6, a carriage 48 mounted on the frame 24 for translational movement mounts part of the moving support mechanism 44 and a picking cylinder 50. The picking cylinder 50 is located in an opening 52 between the front and rear support surfaces 42F, 42R so that the cylinder may be exposed to the bottom workpiece W in the stack S. The carriage 48 has a front structural member 54, a rear structural member 56, each extending between and interconnecting laterally spaced apart side walls (designated 58L and 58R, respectively). Roller mechanisms 60 attached to each side wall mount the carriage 48 on shafts 61 for translational motion with respect to the frame 24. The shafts 61 each extend generally longitudinally of the frame 24 and are connected to opposing upright frame members 24C on respective sides of the frame.

As shown in FIG. 1, a clamping plate 64 attaches the carriage 48 to an endless toothed belt 66 extending around pulleys 68 attached to the left lower frame member 24A, and around the output shaft 70 of a reversible gearhead motor 72 (broadly, "means for actuating relative motion between said support means and the stack and the gripper and the stack"). A controller 74, as described more fully below, is operable to run the motor 72 to drive the carriage 48 in a reciprocating fashion on the shafts 61 under the hopper 26. In the illustrated embodiment, the linear motion system for the carriage 48 is the Thomson SPB-12 manufactured by Thomson Industries, Inc., of Port Washington, N.Y. The Thomson SPB-12 includes pillow blocks (i.e., roller mechanisms 60) having recirculating ball bearings inside which roll freely on the hardened shafts 61. The controller 74 is the Shark X-903 programmable controller sold by Reliance Electric Corp. through their dealers in major cities. However, other linear motion systems and controllers may be used and still fall within the scope of the present invention. In the preferred embodiment, the stack S is stationary and the carriage 48 moves under the stack. However, the carriage 48 may be fixed and the stack could be moved and still fall within the scope of the present invention.

Figure 7:
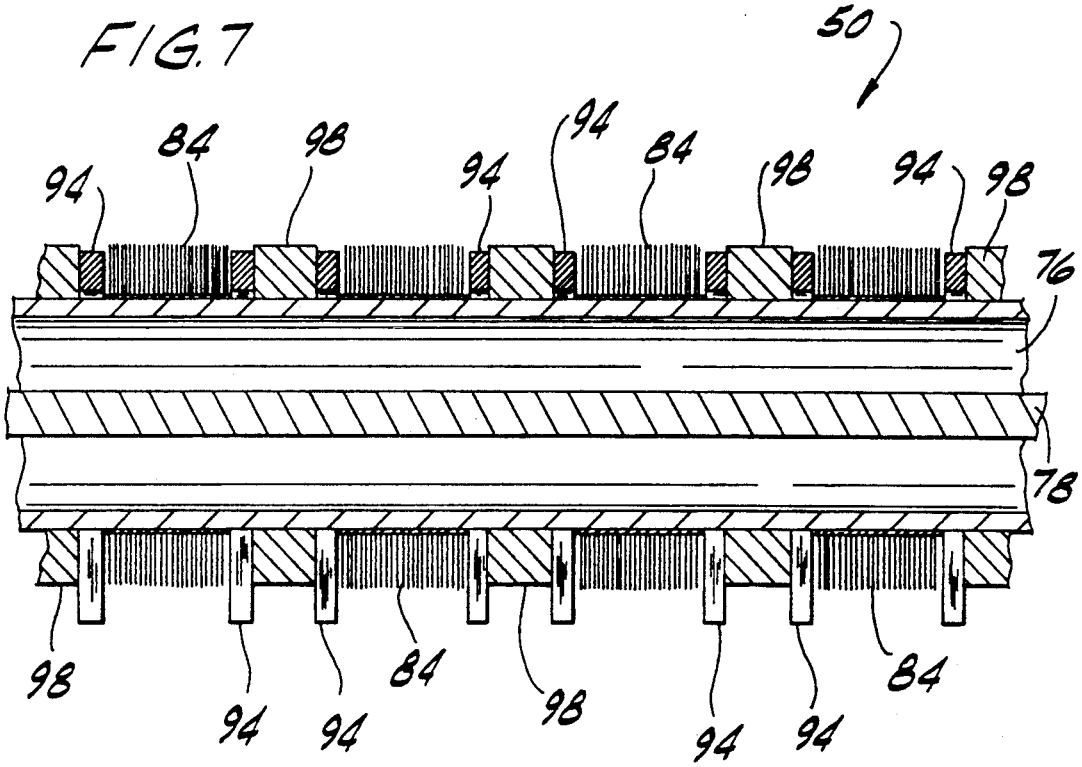
FIG. 7 is a longitudinal section of the picking cylinder.

The picking cylinder 50 is operable to grip the bottom workpiece W in the stack S to separate it from the stack and deposit the workpiece on the conveyor 28 as the carriage 48 passes underneath the stack in a front to rear direction. The picking cylinder 50 includes a roller 76 having a shaft 78 journalled at opposite ends in respective side walls 58L, 58R of the carriage 48 (FIG. 7). As shown in FIG. 1, a sprocket gear 80 mounted on the shaft 78 journalled in and extending through the left side wall 58L of the carriage is enmeshed with a rack 82 mounted on the left upper frame member 24B and extending between the upright frame members 24C on the left side of the frame 24. Thus, upon movement of the carriage 48 in the rearward direction the gear 80 and picking cylinder 50 are rotated in a clockwise direction (as seen in FIG. 1), and upon movement of the carriage in a forward direction, the gear and picking cylinder are rotated in the counterclockwise direction.

Figure 4:
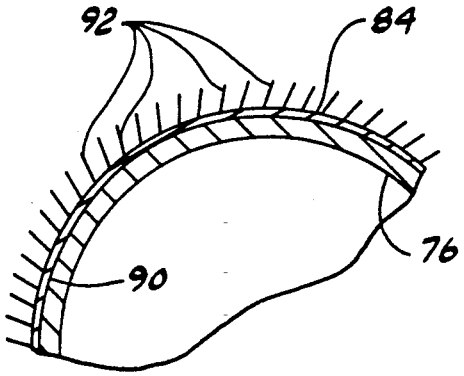
FIG. 4 is a fragmentary cross section of a picking cylinder showing the angulation of its needles.

Means for gripping the bottom workpiece W comprises in this embodiment seven strips of card cloth (each designated 84) wrapped around the roller 76 at locations spaced axially therealong (see FIGS. 4-7). It is to be understood that something other than card cloth or an arrangement other than seven strips spaced axially of the picking cylinder may be used and still fall within the scope of this invention. However, where the workpieces are made of fabric the structure for separating the workpieces preferably should grip the bottom workpiece W rather than engage and pull the bottom workpiece solely through frictional interaction. The strips of card cloth 84 are each attached to the roller 76 by a block 86 which is connected by a screw 88 to the roller. The ends of the card cloth strip 84 are each received under the block 86 and the screw 88 tightens the block against the ends of the card cloth and the roller 76 to clamp it in place. Each strip of card cloth 84 has a substrate 90 and a plurality of needles 92 projecting outwardly from the substrate (FIG. 4). As attached to the roller 76, the needles 92 are generally arranged along a loop around the circumference of the roller. However, the needles 92 have been removed from the substrate 90 at the ends received under the block 86. The needles 92 are oriented with respect to the picking cylinder 50 so that when they engage the bottom workpiece W in the stack (i.e., in a position generally on top of the cylinder) the needles slope forwardly.

For each strip of card cloth 84, a pair of stripper cams (each designated 94) are received on the roller 76 and located on opposite longitudinal edges of the strip of card cloth. As shown in FIG. 6, the stripper cams 94 are held from rotational movement about the longitudinal axis of the roller 76 by front and rear stabilizer rods (96F, 96R, respectively), mounted at respective ends on the side walls 58L, 58R of the carriage 48 and extending between the side walls. The stripper cams 94 are spaced apart by tubular spacers 98 received on the roller 76 and attached to the roller for rotation therewith by a suitable fastener (not shown). Each of the cams 94 has an outer surface adapted for engaging the bottom workpiece in the stack. The outer surface includes a rearward portion 100, located radially outwardly from the picking cylinder 50, which slopes downwardly toward a central recessed portion 102 located radially inwardly of the distal ends of the needles 92 so that the needles are exposed for penetrating and gripping the bottom workpiece W. A forward portion 104 slopes generally outwardly and forwardly of the cylinder 50 beyond the distal ends of the needles 92 for stripping the bottom workpiece from the needles.

Referring now to FIGS. 5 and 6, the moving support mechanism 44 is constructed to support the stack S while simultaneously moving under it without disturbing the workpieces in the stack. The construction of the support mechanism 44 inside the carriage 48 is shown in FIG. 6, which is a section showing only the right sidewall 58R. However, parts of the support mechanism 44 on the left sidewall 58 are identical in construction. The rear web 40R is clamped at a first end 106 to the rear cross member 24D of the frame by a clamping bar 110. From the rear of the frame 24, the rear web 40R extends forwardly over a rear platen 112 affixed to the side walls 58L, 58R of the carriage 48 by flanges 114. The rear platen 112 extends side-to-side and rearwardly of the carriage 48 (FIG. 6). At the opening 52 between the front and rear webs 40L, 40R, the rear web extends around an idler roller 118, rearwardly to tension rollers 120 and then rearwardly to a take up roll 122. The idler roller 118 is mounted by a slide 121 in slots 124 in the side walls 58L, 58R to permit adjustment lengthwise of the frame 24 to change the separation between the forward edge margin of the rear support surface 42R adjacent the opening 52 and the picking cylinder 50. The second end of the rear web 40R is attached to the take up roll 122 which is journalled in the side walls 58L, 58R of the carriage for rotation to take up and let out the rear web from the roll.

The tension rollers 120 are mounted at each end on pivot bars 126 attached to respective side walls 58L, 58R of the carriage 48 by a pin 128 for swinging motion about the axis of the pin. As shown in FIGS. 1 and 2, the pins 128 each extend through a respective side wall 58L, 58R of the carriage 48 and levers 139 are mounted on the ends of the pins outside the side walls. Springs 132 attached to the distal ends of the levers 130 and to the carriage 48 bias the pivot bars 126 to swing the lower of the tension rollers 120 forwardly and the upper of the tension rollers rearwardly to maintain tension on the rear web 40R. The take up roll 122 is connected by a gear 134 on the right side of the carriage 48 to a toothed rack 136 mounted on the right upper frame member 24B and extending between the upright frame members 24C on the right side of the frame 24. Thus, as the carriage 48 moves rearwardly, the take up roll 122 is rotated to take up lengths of the rear web 40R around the roll. Motion of the carriage 48 in the forward direction causes the take up roll 122 to be rotated to let out additional lengths of the rear web 40R.

The front web 40F is arranged on the feeder 20 in a manner similar to the rear web 40R. It extends from a first end 138 clamped by a clamp bar 140 to the front cross member 24D of the frame 24 over a front platen 144 to the opening 52. Brackets 148 mount the front platen 144 on the side walls 58L, 58R of the carriage 48. The front and rear platens 144, 112 support the front and rear webs 40F, 40R so that they will not sag under the weight of the stack S. Like the rear web 40R, the front web 40F extends around an idler roller 146 at the opening 52 and into the carriage 48. However, unlike the rear web 40R, the front web 40F then extends rearward around a second idler roller 146A and downwardly to tension rollers 148. The idler roller 146 is mounted at its ends by slides 149 in slots 150 in the side walls 58L, 58R of the carriage for adjustment to select the separation between the rear edge of the front support surface 42F adjacent the opening 52 and the picking cylinder 50. The second end of the front web 40F is affixed to a take up roll 152 journalled in the side walls 58L, 58R of the carriage at the front of the carriage. The tension rollers 148 are mounted at their ends to respective pivot bars 154 mounted by pins 156 on the side walls 58L, 58R of the carriage for swinging motion about the axis of the pins. On the ends of the pins 156 outside of the side walls 58L, 58R of the carriage are levers 158 which are biased by respective springs 160 to swing the lower of the tension rollers 148 downwardly and the upper of the tension rollers upwardly to maintain tension in the front web 40F (see FIGS. 1 and 2). The take up roll 152 is connected by a gear 162 on the right side of the frame to the toothed rack 136 so that as the carriage moves rearwardly, the take up roll 152 is rotated to let out lengths of the front web 40F (FIG. 2). Motion of the carriage 48 in the forward direction causes the take up roll 152 to be rotated to take up lengths of the front web 40F.

Operation

Before placing a stack S of workpieces to be individually fed to processing machinery, the operator loosens the fasteners holding the rear wall 32 of the hopper 26 and slides the wall into the appropriate position. The position of the rear wall 32 depends upon the size of the workpieces. Generally, the rear wall position should be such that the forward edge margins of the workpieces are located near the front wall 30, over the region where the carriage 48 travels at a slower rate. As explained more fully below, the slower velocity of the carriage 48 and picking cylinder 50 facilitate gripping at the forward edge of the bottom workpiece W.

The start position of the carriage 48, for purposes of this description, is at the front end of the hopper 26, with the centerline of the picking cylinder 50 aligned with or only slightly forward of the forward edge of the bottom workpiece W. The stack S of workpieces in the hopper rests on the rear support surface 42R defined by the rear web, generally over the rear platen 112. As shown in phantom in FIG. 5, the front edge of the workpieces in the stack may be curved or otherwise nonlinear without affecting the operation of the feeder. Based upon the stiffness of the workpieces to be fed, the operator also adjusts the separation between the idler roller 146 and the needles 92 on the picking cylinder 50 by sliding the idler roller in the slots 150 on the side walls 58L, 59R of the carriage and securing the idler roller in a selected position. Generally, the stiffer the workpiece the greater the separation between the idler roller 146 and the needles 92. However, in practice it has been found that many different types of fabric workpieces can be separated and fed using the feeder 20 of the present invention without any adjustment.

Figures 3A, 3B, 3C:
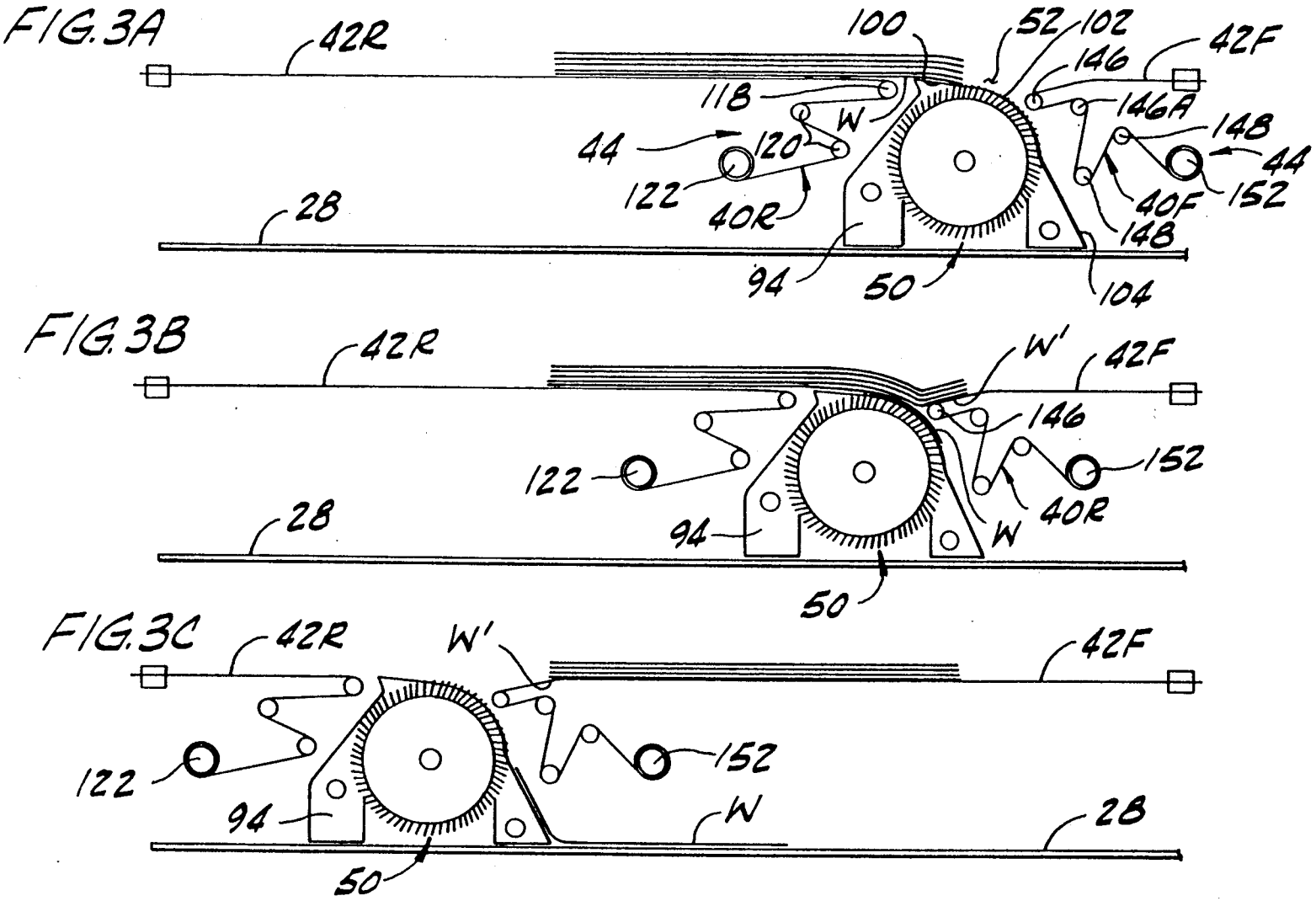
FIGS. 3A-3C are schematic views illustrating the operation of the automatic feeder.

The motor 72 is then activated, and begins to move the carriage 48 in a rearward direction under the hopper 26 and stack S. The operation of the feeder 20 after it is activated is schematically illustrated in FIGS. 3A-3C. The picking cylinder sprocket gear 80 enmeshed in the rack 82 rotates the picking cylinder 50 in a clockwise direction with the velocity of the needles 92 at the point of engagement with the bottom workpiece W being generally equal in magnitude, but opposite in direction to the velocity of the carriage 48. Thus, when the needles 92 engage the bottom workpiece W in the stack S substantially no velocity in a plane parallel to the plane of the workpieces is imparted by the needles to the bottom workpiece. The take up rollers 122, 152 are also rotated upon movement of the carriage 48 through the engagement of their gears 134, 162 in the rack 136. As the carriage 48 moves in the rearward direction, the take up roller 122 of the rear web 40R retracts the web into the carriage, and the take up roller 152 of the front web 40F lets out additional length of the front web. Thus, the rear support surface 42R is withdrawn from under the stack S, and the front support surface 42F is advanced under the stack as the carriage 48 moves rearwardly. The take up rollers 122, 152 and gears 134, 162 have been selected so that the velocities of the rear web 40R and the front web 40F are substantially equal in magnitude, but opposite in direction to the velocity of the carriage 48. The net velocity of the webs 40F, 40R under the stack S is substantially zero. Therefore, no velocity in the plane of the support surfaces is imparted to the stack as the rear support surfaces 42R is withdrawn from and the front support surface 42F is advanced under the stack.

As the opening 52 separating the front and rear support surfaces 42F, 42R begins to pass under the forward edge margin of the bottom workpiece W in the stack, the bottom workpiece is supported at its forward edge by the rearward portions 100 of the upper surfaces of the stripper cams 94. The bottom workpiece W is held by the cams 94 at a location beyond the distal ends of the needles 92 so that no engagement occurs initially. However, as the carriage 48 moves farther rearwardly, the forward edge margin of the bottom workpiece W advances down the rearward portions 100 of the upper surfaces of the stripper cams 94 to the central recessed portions 102, where an area of the workpiece is exposed to the distal ends of the needles 92. Portions of the area of the bottom workpiece exposed to the needles 92 are penetrated by the ends of the needles, which grip the area and peel it away from the next lowest workpiece in the stack S as the needles continue to move clockwise (as seen in FIGS. 3A-3C) and descend into the carriage 48.

The idler roller 146 at the front side of the opening is disposed in generally close proximity to the ends of the needles 92 and below the plane of the first and second platens 112, 144 and the idler roller 118 on the rear side of the opening 52. As the forward edges of the bottom workpiece W and next lowest workpiece W' reach the idler roller 146, the front web 40F wipes between the bottom and next lowest workpiece to facilitate their separation (see FIG. 3B). The direction of motion of the front web 40F over the idler roller 146 is substantially upward at the location where the next lowest workpiece W' engages it. The needles 92 have a substantial downward component to their movement at the idler roller 146. This opposing action of the needles 92 on the bottom workpiece W and of the front web 40F on the next lowest workpiece W' facilitates separation.

The gripping of the bottom workpiece W with the needles 92 on the picking cylinder 50, and wiping action between the bottom workpiece and the workpiece W' immediately above it in the stack S by the forward web 40F at the idler roller 146 continue across the entire bottom of the stack S in the direction of travel of the carriage 48. Thus, a clean separation of the bottom workpiece in the stack may be achieved notwithstanding the tendency of the bottom workpiece to adhere to the workpiece W' immediately above it. The feeder 20 is operable to separate workpieces having a forward edge which is straight, convex, concave curving edges, pointed or otherwise irregular without any change in the machine adjustment.

The leading edge of the bottom workpiece W continues to travel generally along the outer surface of the stripper cam 94. The forward portions 104 of the upper surfaces of cams 94 guide the bottom workpiece W forwardly away from the picking cylinder 50 acts to strip the bottom workpiece off the needles 92. The bottom workpiece W is then guided by the forward portions 104 onto the conveyor 28 (which is travelling in a forward direction), as shown in FIG. 3C.

The controller 74 initially operates the motor 72, to drive the carriage 48 at a first, slower speed which has been found to facilitate the needles 92 gripping the forward edge margin of the bottom workpiece W. Once the carriage 48 has travelled a predetermined distance, allowing the leading edge margin of the bottom workpiece W to be gripped by the needles 92, the carriage is detected by a first sensor 164 attached to a rod 166 mounted on the right side of the frame 24 and extending longitudinally of the frame. The first sensor 164 signals the controller 74 to run the motor 72 at a higher speed for moving the carriage 48 more swiftly toward the rear of the frame 24. The needles 92 progressively and substantially continuously engage and grip portions of areas of the bottom workpiece presented over the opening 52 across the entire length of the workpiece in the front to rear direction. Thus, the gripping and separating action of the needles 92 is not confined to the leading edge margin of the bottom workpiece W, but occurs over the whole length of the workpiece.

The controller 74 slows the motor 72 upon detection of the carriage 48 by a second sensor 168 attached to the rod 166. The direction of travel of the carriage 48 is stopped and then reversed when the carriage is detected by a third sensor 170 located rearwardly of the second sensor 168. The slowing of the carriage 48 after detection by the second sensor 168 reduces the momentum of the carriage and therefore prevents substantial jarring of the frame 24 when the carriage is later stopped and reversed.

The directions of rotation of the picking cylinder 50 and take up rolls 122, 152 are reversed when the carriage 48 moves in the forward direction. The rear web 40R is now extended from its take up roll 122 so that the rear support surface 42R may again extend under the stack S. Conversely, the front web 40F is retracted into the carriage 48 on the take up roll 152, and the front support surface 42F is gradually withdrawn from under the stack S as the carriage moves forwardly. The velocities of the webs are again substantially equal in magnitude but opposite in direction to the velocity of the carriage so that no velocity is imported to the stack. The needles 92 do not impart any velocity in the plane of the bottom workpiece W to the stack S as the carriage 48 travels forwardly because their velocity at the location of engagement with the bottom workpiece is also substantially equal in magnitude, but opposite in direction to that of the carriage 48. The forwardly swept orientation and counterclockwise rotation of the needles 92 engaging the bottom workpiece W prevents them from penetrating and gripping the bottom workpiece. Thus, no mechanism for retracting the needles 92 as the carriage 48 passes forwardly under the stack S is required.

The first sensor 164 signals the controller 74 to slow the carriage 48 upon its detection. The forward motion of the carriage 48 is halted by the controller 74 when the carriage is detected by a fourth sensor 172 located forward of the first sensor 164, and the controller 74 again initiates rearward travel of the carriage. The location of the sensors 164, 168, 170, 172 may be selectively adjusted along the length of the bar 166. The operation described above (subsequent to the steps carried out to initially set up the feeder) is repeated and the new bottom workpiece in the stack is separated from the stack and fed onto the conveyor. As the workpieces in the stack are being separated and fed to the conveyor, additional workpieces may be added to the top of the stack without interrupting operation.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An automatic feeder for feeding workpieces of limp material one at a time and one after another from a stack of workpieces, the feeder comprising:

means for supporting the stack;

a gripper located generally underneath the stack and said support means, the gripper including means for gripping the bottom workpiece, said support means having an opening therein for exposing the bottom workpiece in the stack to said gripping means;

means for actuating relative motion between said support means and the stack and the gripper and the stack such that the opening in said support means and the gripper pass conjointly under the stack in a rearward direction generally from one end of the stack to the other thereby to progressively present areas of the bottom workpiece over the opening with said gripping means of the gripper progressively and successively gripping at least a portion of the areas of the bottom workpiece as they are exposed to said gripping means over the opening to peel the areas of the bottom workpiece generally downwardly away from the stack and releasing the areas peeled away thereby to separate the bottom workpiece from the stack.

2. An automatic feeder as set forth in claim 1 wherein said gripping means of the gripper comprises means penetrating the bottom workpiece thereby to grip the bottom workpiece for peeling away from the stack.

3. An automatic feeder as set forth in claim 2 wherein said penetrating means comprises a plurality of needles arranged generally along at least one loop and adapted for motion around the loop as the gripper and opening in the support means travel rearwardly under the stack such that needles are substantially continuously brought into penetrating engagement with the bottom workpiece in the stack to grip the bottom workpiece and peel the bottom workpiece away from the stack.

4. An automatic feeder as set forth in claim 3 wherein the velocity of the needles at the point of engagement with the bottom workpiece is approximately equal in magnitude but opposite in direction to the velocity of the gripper relative to the stack whereby substantially no velocity in a plane parallel to the planes of the workpieces in the stack is imparted by the needles to the bottom workpiece.

5. An automatic feeder as set forth in claim 4 wherein the needles are oriented on the gripper so that when they engage the bottom workpiece the needles are sloped forwardly.

6. An automatic feeder as set forth in claim 3 wherein the gripper comprises a picking cylinder mounted for rotation about its longitudinal axis on the feeder, the needles being arranged on the cylinder generally along a plurality of circular loops spaced axially of each other, each loop extending circumferentially of the cylinder.

7. An automatic feeder as set forth in claim 6 wherein the gripper further comprises means for withdrawing the needles from the bottom workpiece thereby to release the bottom workpiece from the gripper.

8. An automatic feeder as set forth in claim 7 wherein said withdrawing means comprises a plurality of stripper cams.

9. An automatic feeder as set forth in claim 8 wherein each stripper cam has an outer surface adapted for engaging the bottom workpiece, the outer surface including a rearward portion located radially outwardly with respect to the cylinder from the distal ends of the needles, a central recessed portion located forwardly of the rearward portion and radially inwardly of the distal ends of the needles thereby exposing the needles for gripping the bottom workpiece, and a forward portion sloping generally outwardly and forwardly of the cylinder beyond the distal ends of the needles for stripping the bottom workpiece from the needles.

10. An automatic feeder as set forth in claim 6 further comprising:

a carriage mounting the gripper and a portion of said support means thereon;

a frame fixedly mounting the hopper and mounting the carriage for translational movement thereon, a motor for driving movement of the carriage on the frame, and control means for controlling the operation of said motor, the frame having a toothed rack extending in the direction of travel of the carriage, and the picking cylinder having a gear engaged with the rack such that upon movement of the carriage the cylinder is rotated about its longitudinal axis, the velocity of the needles at the point of engagement with the bottom workpiece being generally equal in magnitude, but opposite in direction to the velocity of the gripper relative to the stack whereby substantially no velocity in a plane parallel to the plane of the workpieces in the stack is imparted by the needles to the bottom workpiece.

11. An automatic feeder as set forth in claim 10 wherein said control means is operable to control the motor to drive the carriage at a first velocity in a rearward direction for a predetermined distance and then to control the motor to drive the carriage at a second velocity greater than the first in the rearward direction, the controller operating the motor to increase the velocity of the carriage from said first velocity to said second velocity at a location rearward of a location where the needles engage a forward edge margin of the bottom workpiece.

12. An automatic feeder as set forth in claim 11 wherein said control means is further operable to control the motor to show the carriage from the second velocity near the end of its run in the rearward direction, and to reverse the direction of travel of the carriage at the end of its run in an opposite direction as the carriage moves forwardly such that the needles engage but do not grip the bottom workpiece as the gripper moves under the stack.

13. An automatic feeder as set forth in claim 3 wherein the gripper comprises a picking cylinder mounted for rotation about its longitudinal axis on the feeder, said gripping means being arranged on the cylinder generally along a plurality of circular loops spaced axially of each other, each loop extending circumferentially of the cylinder.

14. An automatic feeder as set forth in claim 13 wherein the gripper further comprises a plurality of stripper cams for stripping the bottom workpiece from said gripping means thereto to release the bottom workpiece from the gripper, each stripper cam having an outer surface adapted for engaging the bottom workpiece, the outer surface including a rearward portion located radially outwardly with respect to the cylinder from said gripping means, a central recessed portion located forwardly of the rearward portion and radially inwardly of said gripping means thereby exposing said gripping means for gripping the bottom workpiece, and a forward portion sloping generally outwardly and forwardly of the cylinder beyond said gripping means for stripping the bottom workpiece from said gripping means.

15. An automatic feeder as set forth in claim 14 further comprising:

a carriage mounting the gripper and a portion of said support means thereon;

a frame fixedly mounting the hopper and mounting the carriage for translational movement thereon, a motor for driving movement of the carriage on the frame, and control means for controlling the operation of said motor, said control means being operable to control the motor to drive the carriage at a first velocity in a rearward direction for a predetermined distance and then to control the motor to drive the carriage at a second velocity greater than the first in the rearward direction, the controller operating the motor to increase the velocity of the carriage from said first velocity to said second velocity at a location rearward of a location where said gripping means engage a forward edge margin of the bottom workpiece the frame having a toothed rack extending in the direction of travel of the carriage, and the picking cylinder having a gear engaged with the rack such that upon movement of the carriage the cylinder is rotated about its longitudinal axis, the velocity of said gripping means at the point of engagement with the bottom workpiece being generally equal in magnitude, but opposite in direction to the velocity of the gripper relative to the stack whereby substantially no velocity in a plane parallel to the plane of the workpieces in the stack is imparted by said gripping means to the bottom workpiece.

16. An automatic feeder as set forth in claim 15 wherein said support means comprises means defining a rear support surface located generally rearwardly of the gripper and means defining a front support surface located generally forwardly of the gripper, the front and rear support surfaces being spaced apart at the gripper to define the opening in said support means, said means defining a rear support surface being adapted to withdraw the rear support surface from under the stack as the gripper moves rearwardly and to advance the rear support surface under the stack as the gripper moves forwardly, and said means for defining a front support surface being adapted to advance the front support surface under the stack as the gripper moves rearwardly and to withdraw the front support surface from under the stack as the gripper moves forwardly, the front and rear support surfaces moving with a velocity substantially equal in magnitude but opposite in direction to the velocity of the carriage as the support surfaces are withdrawn from and advanced under the stack whereby no velocity in a plane parallel to the plane of the front and rear support surfaces is imparted to the stack.

17. An automatic feeder as set forth in claim 16 wherein said means defining a front support surface comprises a rear web, and wherein said support means further comprises means for holding the rear web disposed at the forward boundary of the opening in said support means for engagement with a workpiece in the stack immediately above the bottom workpiece as the bottom workpiece is separated from the stack, the rear web being adapted to move with a velocity having a vertical component at said holding means such that the rear web imparts an upward velocity to the stack thereby to facilitate separation of the bottom workpiece from the stack, said holding means being selectively adjustable to change the spacing between the front support surface and said gripping means.

18. An automatic feeder as set forth in claim 1 wherein said support means comprises means defining a rear support surface located generally rearwardly of the gripper and means defining a front support surface located generally forwardly of the gripper, the front and rear support surfaces being spaced apart at the gripper to define the opening in said support means, said means defining a rear support surface being adapted to withdraw the rear support surface from under the stack as the gripper moves rearwardly and to advance the rear support surface under the stack as the gripper moves forwardly, and said means for defining a front support surface being adapted to advance the front support surface under the stack as the gripper moves rearwardly and to withdraw the front support surface from under the stack as the gripper moves forwardly, the front and rear support surfaces moving with a velocity substantially equal in magnitude but opposite in direction to the velocity of the gripper as support surfaces are withdrawn from and advanced under the stack whereby no velocity in a plane parallel to the plane of the front and rear support surfaces is imparted to the stack.

19. An automatic feeder as set forth in claim 18 wherein said means defining a front support surface comprises a rear web, and wherein said support means further comprises means for holding the rear web disposed at the forward boundary of the opening in said support means for engagement with a workpiece in the stack immediately above the bottom workpiece as the bottom workpiece is separated from the stack, the rear web being adapted to move with a velocity having a vertical component at said holding means such that the rear web imparts an upward velocity to the stack thereby to facilitate separation of the bottom workpiece from the stack.

20. An automatic feeder as set forth in claim 19 wherein said holding means is selectively adjustable to change the spacing between the front support surface and the needles.

21. An automatic feeder for feeding workpieces of limp material one at a time and one after another from a stack of workpieces, the feeder comprising:

means for supporting the stack;

a gripper located generally underneath the stack and said support means, the gripper including a plurality of spaced-apart means for gripping the bottom workpiece, said support means having an opening therein for exposing the bottom workpiece in the stack to said gripping means;

said gripping means being arranged along a loop and adapted for motion around the loop as the gripper and opening in said support means travel rearwardly under the stack;

means for actuating relative motion between said support means and the stack and the gripper and the stack such that the opening in said support means and the gripper pass conjointly under the stack in a rearward direction generally from one end of the stack to the other thereby to progressively present areas of the bottom workpiece over the opening with said gripping means of the gripper progressively and successively gripping at least a portion of the areas of the bottom workpiece as they are exposed to said gripping means over the opening to peel the areas of the bottom workpiece generally downwardly away from the stack and releasing the areas peeled away thereby to separate the bottom workpiece from the stack.

22. A method for mechanically separating a bottom workpiece of limp material from a stack of workpieces, the method comprising the steps of:

providing means for supporting the stack;

providing a mechanical gripper located generally underneath the stack and said support means, the gripper including means for gripping the bottom workpiece, said support means having an opening therein for exposing the bottom workpiece in the stack to said gripping means;

actuating relative motion between said support means and the stack and the gripper and the stack such that the opening in said support means and the gripper pass conjointly under the stack in a rearward direction generally from one end of the stack to the other thereby to progressively present areas of the bottom workpiece over the opening;

progressively and successively gripping at least a portion of the areas of the bottom workpiece with said gripping means as they are exposed to said gripping means over the opening to peel the areas of the bottom workpiece generally downwardly away from the stack; and releasing the areas peeled away thereby to separate the bottom workpiece from the stack.

* * * * *

UNITED STATES PATENT AND TRADEMARK OFFICE
CERTIFICATE OF CORRECTION

PATENT NO. : 5,314,178

DATED : May 24, 1994

INVENTOR(S) : William R. Cole et al.

It is certified that error appears in the above-identified patent and that said Letters Patent is hereby corrected as shown below:

Column 11, claim 12, line 26, "to show the carriage" should read ---to slow the carriage---.

Column 11, claim 12, line 29, "run in an opposite direction" should read ---run in the rearward direction, the picking cylinder rotating in an opposite direction---.

Signed and Sealed this

Eighteenth Day of October, 1994

*Attest:*

Bruce Lehman

BRUCE LEHMAN

*Attesting Officer*

*Commissioner of Patents and Trademarks*